US006944953B2

(12) United States Patent
Momosaki

(10) Patent No.: US 6,944,953 B2
(45) Date of Patent: Sep. 20, 2005

(54) CORNER CUTTER

(75) Inventor: Mitsukazu Momosaki, Fukuoka (JP)

(73) Assignee: Alpha Professional Tools, Wyckoff, NJ (US)

( * ) Notice: Subject to any disclaimer, the term of this patent is extended or adjusted under 35 U.S.C. 154(b) by 262 days.

(21) Appl. No.: 09/765,960

(22) Filed: Jan. 19, 2001

(65) Prior Publication Data

US 2001/0025422 A1 Oct. 4, 2001

(51) Int. Cl.[7] ..... B26B 17/00
(52) U.S. Cl. ..... 30/178; 30/229; 30/262
(58) Field of Search ..... 30/178, 28, 262, 30/229; 225/96, 103; D8/52

(56) References Cited

U.S. PATENT DOCUMENTS

| | | | | | |
|---|---|---|---|---|---|
| 186,726 | A | * | 1/1877 | Hamilton | 30/178 |
| 287,589 | A | * | 10/1883 | Stevens | 30/193 |
| 300,031 | A | * | 6/1884 | Taft | 30/134 |
| 450,703 | A | * | 4/1891 | Price | 30/28 |
| 483,550 | A | * | 10/1892 | Gerard | 30/262 |
| 483,869 | A | * | 10/1892 | Randle | 30/186 |
| 533,527 | A | * | 2/1895 | Carmody | 30/229 |
| 568,242 | A | * | 9/1896 | Fay | 30/271 |
| 690,925 | A | * | 1/1902 | Capewell | 30/271 |
| 726,859 | A | * | 5/1903 | Capewell | 30/193 |
| 813,598 | A | * | 2/1906 | Sylvester | 30/178 |
| 823,519 | A | * | 6/1906 | Falconer | 30/178 |
| 835,900 | A | * | 11/1906 | Casterlin | 30/252 |
| 927,990 | A | * | 7/1909 | Merrifield | 30/229 |
| 1,363,164 | A | * | 12/1920 | Oesterwitz | 30/28 |
| 1,755,417 | A | * | 4/1930 | Ames | 30/179 |
| 1,887,732 | A | * | 11/1932 | Pagel et al. | 72/409.01 |
| 2,005,487 | A | * | 6/1935 | Zemanek | 225/103 |
| 2,090,341 | A | * | 8/1937 | Burnham | 30/193 |
| 2,422,207 | A | * | 6/1947 | Nalpantian | 30/28 |
| 2,507,345 | A | * | 5/1950 | Meesook | 30/28 |
| 2,589,501 | A | * | 3/1952 | Lenarduzzi | 30/164.5 |
| 2,612,686 | A | * | 10/1952 | Wagner | 30/178 |
| 2,736,218 | A | * | 2/1956 | Atkeson | 225/103 |
| 2,742,696 | A | * | 4/1956 | Williams | 30/178 |
| 2,823,565 | A | * | 2/1958 | Bohland | 225/93 |
| 2,839,827 | A | * | 6/1958 | David | 30/28 |
| 2,985,957 | A | * | 5/1961 | Freedman | 30/28 |
| 3,143,905 | A | * | 8/1964 | Ramseier et al. | 30/169 |
| 3,928,878 | A | * | 12/1975 | VanHeuman | 30/90.1 |
| 4,090,420 | A | * | 5/1978 | Insolio | 225/103 |
| 4,106,195 | A | * | 8/1978 | Berg | 30/178 |
| 4,172,320 | A | * | 10/1979 | Welborn | 30/134 |
| 4,326,334 | A | * | 4/1982 | Roux | 30/124 |
| 4,361,130 | A | * | 11/1982 | Maglia | 225/103 |
| 4,444,174 | A | * | 4/1984 | Hepworth et al. | 225/96.5 |
| 4,462,403 | A | * | 7/1984 | Martin | 30/190 |
| 4,550,634 | A | * | 11/1985 | Speegle | 30/134 |
| 4,573,617 | A | * | 3/1986 | Durkow | 30/164.9 |
| 4,860,448 | A | * | 8/1989 | Husain | 30/28 |
| 4,878,260 | A | * | 11/1989 | Tunningley et al. | 30/164.95 |
| 4,991,471 | A | * | 2/1991 | Herrmann | 225/96.5 |
| 5,101,563 | A | * | 4/1992 | d'Orgelys | 30/28 |
| D330,495 | S | * | 10/1992 | Cripe | D8/52 |
| D349,636 | S | * | 8/1994 | White et al. | D8/52 |
| 5,357,676 | A | * | 10/1994 | Bannett | 30/28 |
| 5,365,915 | A | * | 11/1994 | Yu | 30/145 |
| 5,452,705 | A | * | 9/1995 | Horng | 30/145 |
| D386,658 | S | * | 11/1997 | Jansson et al. | D8/52 |
| 5,881,461 | A | * | 3/1999 | Schwartz | 30/28 |
| 5,890,295 | A | * | 4/1999 | Wachtel et al. | 30/28 |
| 6,016,733 | A | * | 1/2000 | Lin | 83/467.1 |
| 6,305,086 | B1 | * | 10/2001 | Burgholzer | 30/186 |
| 6,425,183 | B2 | * | 7/2002 | Lemmens | 30/186 |
| 6,434,830 | B1 | * | 8/2002 | Wu | 30/135 |
| 6,473,969 | B2 | * | 11/2002 | Rinaldi | 30/28 |
| 6,517,545 | B1 | * | 2/2003 | Mazur | 606/83 |
| D472,119 | S | * | 3/2003 | Burrows | D8/52 |
| 6,807,961 | B2 | * | 10/2004 | Burrows | 30/252 |

FOREIGN PATENT DOCUMENTS

| | | |
|---|---|---|
| JP | H10-210059 | 1/2000 |

* cited by examiner

*Primary Examiner*—Allan N. Shoap
*Assistant Examiner*—Jason Prone
(74) *Attorney, Agent, or Firm*—Weingram & Associates, P.C.

(57) ABSTRACT

A cutting tool provides a device for cutting a plate glass corner. The structure includes upper and lower blades which are opened and closed to cut the plate glass. The upper and lower blade edge lines mutually oppose each other to form a cutter body having a scissor shape. The upper and lower blade edge lines also coincide with the planned cut line of the corner section of the plate glass.

12 Claims, 6 Drawing Sheets

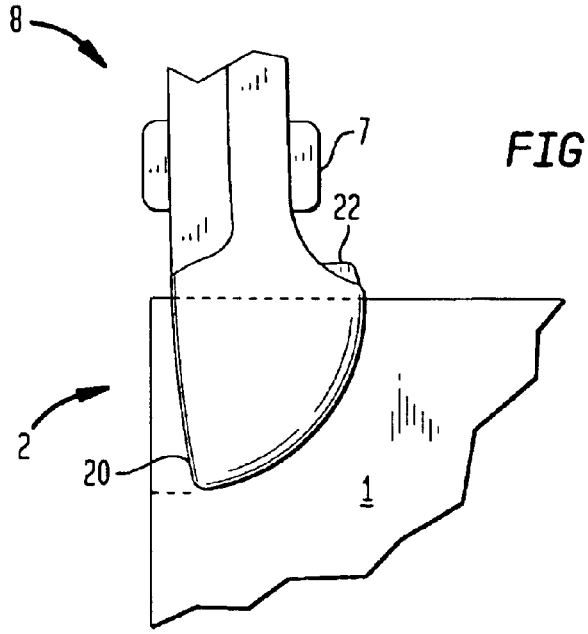
FIG. 11
FIG. 12
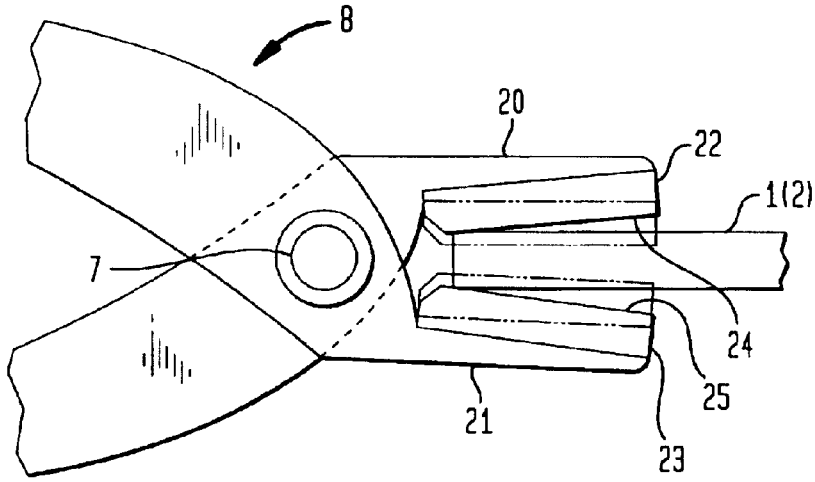
FIG. 13
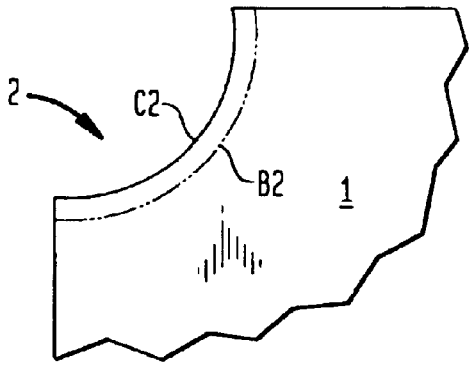

CORNER CUTTER

BACKGROUND OF THE INVENTION

This invention pertains to a corner cutter.

Previously, corner section treatments such as rounding off tangent sections of a sheet of brittle material, such as plate glass, that is shaped in a right angle, were finished by grinding operations. Cutting tools with upper and lower blade edges opposing each other and opening and closing, known as "chewing", were used as a pretreatment of this grinding operation. The section cut off from the edge of the sheet of brittle material to a planned cut line that was determined to remain outside of a planned finish line had operations performed with bit-by-bit erosion.

Known operations with bit-by-bit cutout sections by chewing in the pretreatment step prior to finishing operations had problems such as taking a lot of time and labor as well as requiring a fair amount of skill. and lower blade edge lines mutually opposing each other on a cutter main body in a scissor-like shape with the opening and closing motion of the upper and lower blades cutting the plate glass. Further, the same upper and lower blade edge lines substantially coincide at a planned cut line of the plate glass corner section.

Also, the following characteristics are added.

At least one end section of the upper and lower blade edge lines of the upper and lower blades are disposed to provide a position outside the plate glass in a condition where the upper and lower blades are closed.

The space between the end sections of the upper and lower blade edge lines is narrower than the space between the center section of the upper and lower blade edge lines when the upper and lower blades are closed.

The center section of the upper and lower blade edge lines curves ourwardly toward the cutter body side and toward the reverse side of the cutter body.

The sheets of brittle materials are in the form of plate glass, mirrors, bathroom tiles and roof tiles.

BRIEF DESCRIPTION OF THE DRAWINGS

FIG. 11 is a partial plan view showing utilization of a corner cutter of the second embodiment.

FIG. 12 is a partial lateral view showing utilization of a corner cutter of the second embodiment.

FIG. 13 is a partial plan view of a corner section of the second embodiment.

DESCRIPTION OF THE PREFERRED EMBODIMENTS

An actual embodiment of the invention is as follows.

Upper and lower blades which open and close and are mutually opposing each other are established on a blade section of a cutter body that is formed in a scissor-like shape. The upper and lower blade edge lines of the upper and lower blades substantially coincide at a planned cut line of the plate glass, and the plate glass is cut out along the planned cut line.

Further, the upper and lower blade edge line is longer than the planned cut line and both edges of the upper and lower blade edge line provide a position outside the plate glass. The space between opposite end sections of the upper and lower blade edge lines is narrower than the space between the center sections of the upper and lower blade edge lines. During the cutting operation, the distribution of the clamping pressure of the upper and lower blades on the plate glass is the greatest at the plate glass edge and gradually lessens relative to the center section. The crack that is produced at the plate glass edge runs toward the center section along the upper and lower blade edge lines.

EXAMPLES

Actual examples of the invention are explained by referring to the Figures.

Figure 5:
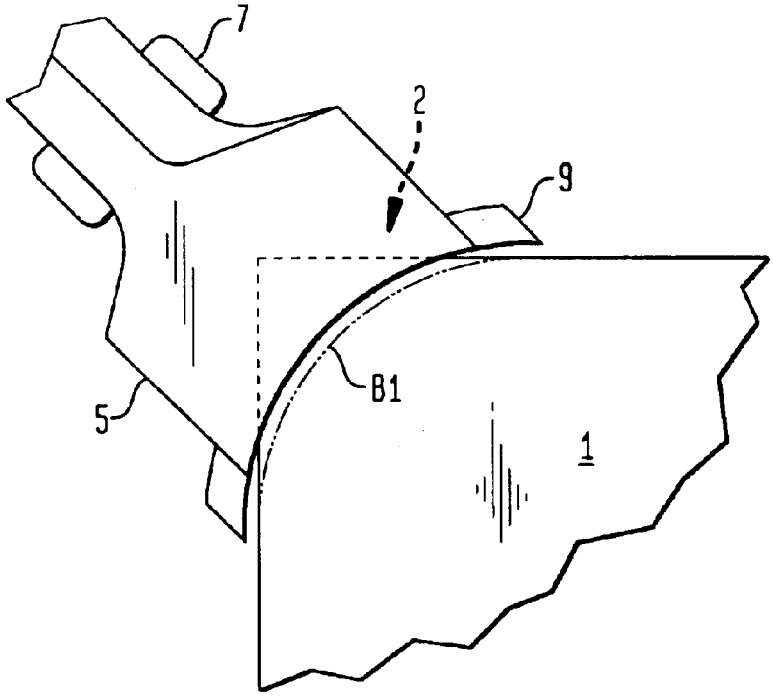
FIG. 5 is a partial plan view showing utilization of a corner cutter of the first embodiment.
Figure 6:
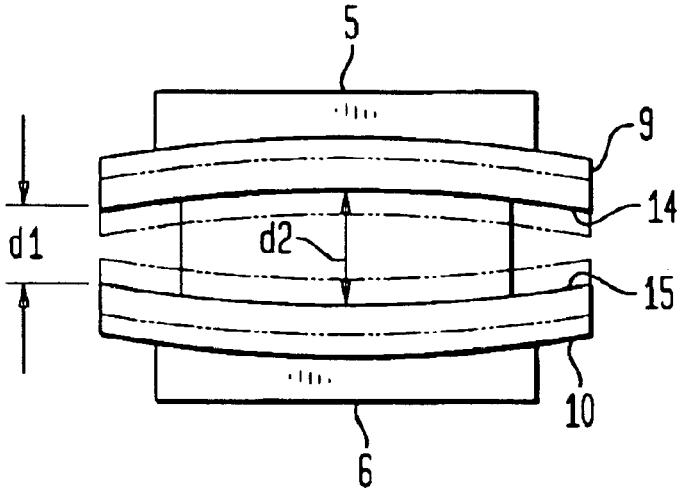
FIG. 6 is a front view showing utilization of a corner cutter of the first embodiment.
Figure 7:
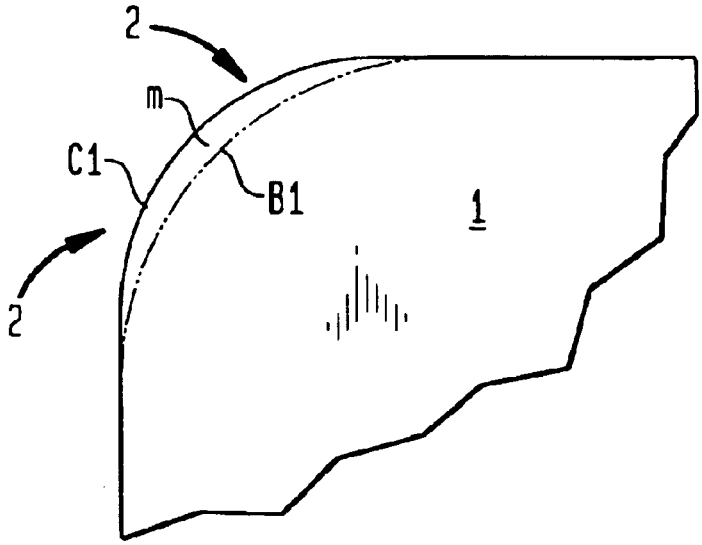
FIG. 7 is a partial plan view of a corner section of the first embodiment.
Figure 8:
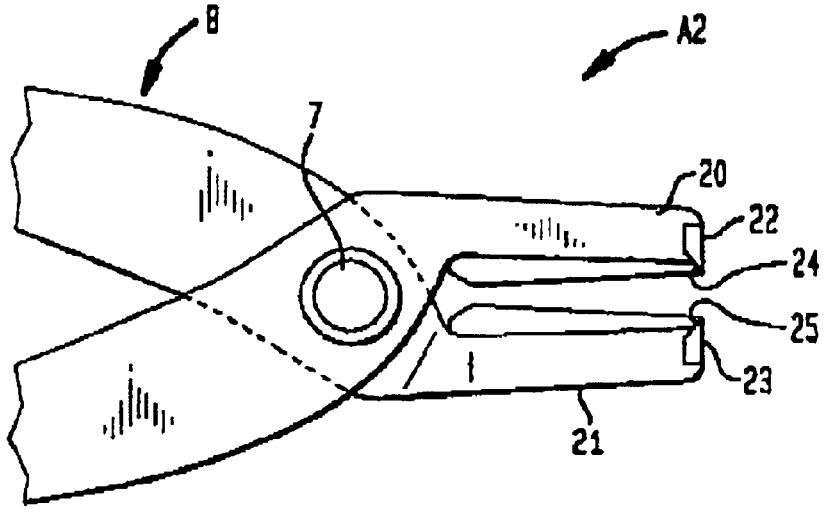
FIG. 8 is a partial lateral view of a corner cutter pertaining to a second embodiment of the present invention.
Figure 9:
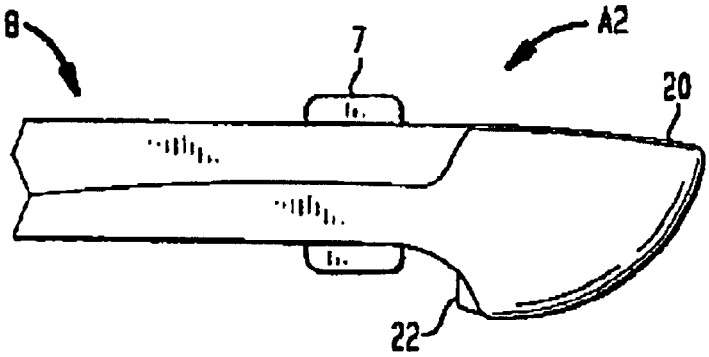
FIG. 9 is a partial plan view thereof.
Figure 10:
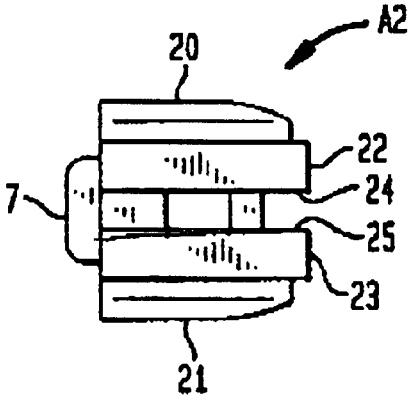
FIG. 10 is a front view thereof.

FIGS. 1–6 show a first example of a corner cutter A1 of the present invention. This corner cutter A1 shapes a corner section 2 of a sheet of brittle material, such as plate glass 1, into an almost one quarter arch shape with the center section curving outwardly as shown in FIG. 7. The right handle section 3 and upper blade edge section 5 are formed as one unit and the left handle section 4 and lower blade edge section 6 are formed as another unit which are pivotally attached to swing freely by means of pivot 7. A scissor-like shaped cutter body 8 is formed and the upper and lower blades 9, 10, which are formed from ultra-hard metal alloys, are set in upper and lower blade edge sections 5, 6. In the Figures, 11 are handle section covers, 12 is a return spring, and 13 is a stop that maintains cutter body 8 in an open condition.

Figure 1:
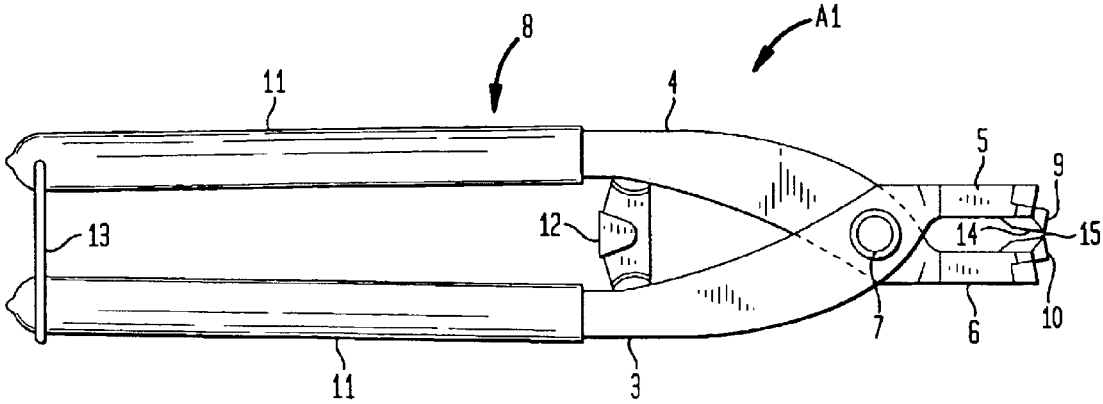
FIG. 1 is a lateral view of a corner cutter pertaining to a first embodiment of the present invention.
Figure 2:
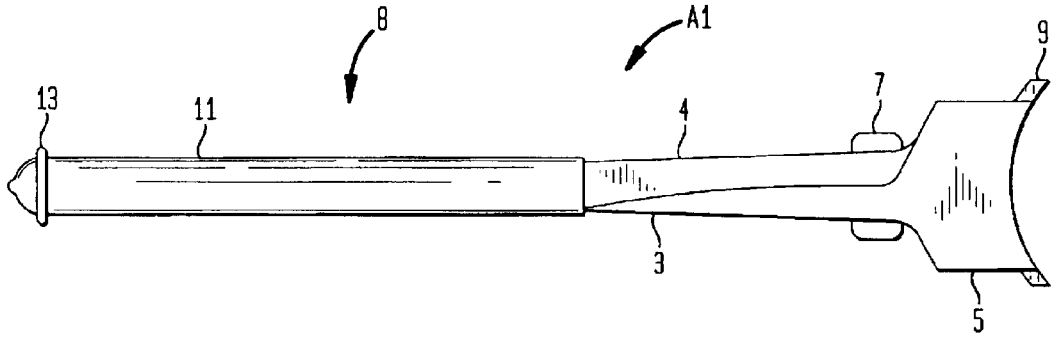
FIG. 2 is a plan view thereof.
Figure 3:
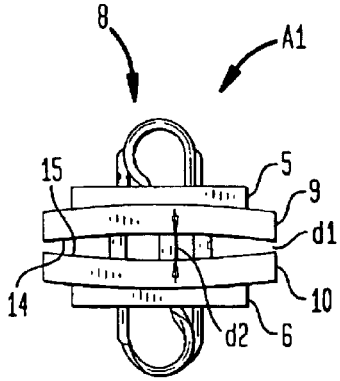
FIG. 3 is a front view thereof.
Figure 4:
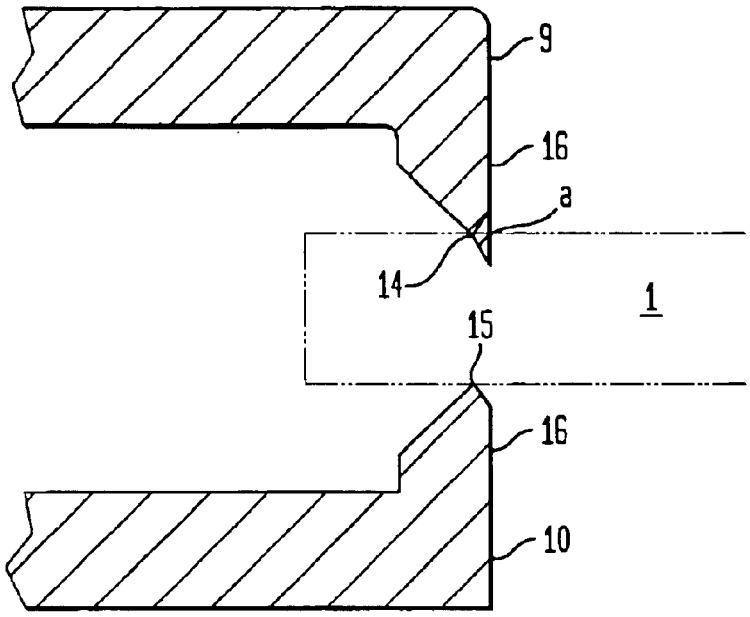
FIG. 4 is a partial cross-sectional lateral view of the upper and lower blades of the first embodiment.

The upper and lower blade edge lines 14, 15 of upper and lower blades 9, 10 are formed in a substantially one quarter arc shape and the center sections curve to the side of cutter body 8, as shown in the plan views of FIG. 2 and FIG. 5 and are formed to coincide with the planned cut line C1 of FIG. 7. Further, the space d1 of the upper and lower blade edge lines 14, 15 between the left and right edges is narrower than the space d2 between the center sections of the upper and lower blade edge lines 14, 15 in the condition where the upper and lower blades are closed, as shown in the front view of FIG. 3. Also, the upper and lower blade edge lines 14,15 of the upper and lower blades 9,10 edges are exactly opposite, as shown in the cross-sectional diagram of FIG. 4, and the plate glass 1 receives clamping pressure between the upper and lower blade edge lines 14, 15 by the opening and closing of the upper and lower blade edge sections 5, 6. The outside surface 16 of the upper and lower blades 9, 10 is formed to be perpendicular to plate glass 1, which is the object to be cut, and only the inside surface is formed as a single blade edge with a rake or angle a.

The method of using a corner cutter A1 of the first Example is as follows.

Planned cut line C1 is set by establishing the outside grinding material m shown in FIG. 7, of the planned finish line B1, by marking off line B1 on a corner section 2 of plate glass 1 as shown in FIG. 5. The upper and lower blade edge lines 14, 15 conform to the planned cutting line C1, and both the right and left edge sections of the upper and lower blade edge lines 14, 15 are positioned outside the edge of plate glass 1. When upper and lower blade edge sections 5, 6 are closed by squeezing the right and left handles 4, 3, as shown in FIG. 6, the plate glass 1 is clamped between upper and lower blade edge lines 14, 15. But, as aforementioned, clamping pressure is produced in both directions where crossing orthogonally at the surface of plate glass 1 between the upper and lower blade edge lines 14, 15 which are exactly opposite and the distribution of the clamping pressure is greatest at both edge sections of planned cut line C1 and gradually decreases relative to approaching the center section.

The crack which is produced in plate glass 1 is first produced at both edge sections of the planned cut line C1 periphery where the clamping pressure is the greatest, then moves from that toward the center section of cut line C1, and divergences from cut line C1 are prevented by controlling the clamping pressure of the upper and lower blades 9, 10.

Further, a section outside planned cutting line C1 is crushed since a rake a, shown in FIG. 4, is formed only at the inside surface of upper blade 9 which engages an opposing surface of lower blade 10. The original form is maintained for the section inside planned cut line C1 and the forming of a corner section 2 in cut line C1 as shown in FIG. 7 is possible, since a crack along cut line C1 is produced in front of where this crushing occurs and crushing proceeding to inside beyond the same crack is prevented.

After the cutting operation is performed, the comer section 2 is ground and finished to planned finish line B1 with items like a grinder or whetstone.

FIGS. 8–12 show a second example of a corner cutter A2. The corner section 2 of plate glass 1 shown in FIG. 13 is one that is cut along a planned finish line B2 of about a one quarter arch shape with a center section that curves inwardly. Planned cut line C2 establishes the grinding material from planned finish line B2, and is shaped in the one quarter arch shape with the center section curved inwardly.

Upper and lower blades 22, 23 curve in about a one quarter arch shape outside the center section for upper and lower blade edge sections 20, 21 of cutter body 8 that is formed substantially in the same way as the aforementioned first Example. One of the end sections of the upper and lower blades 22, 23 is parallel with the length of cutter body 8 and the other end section is positioned orthogonally to the length.

The upper and lower blades 22, 23 are also mutually exactly opposite the upper and lower blade edge lines 24, 25 in the same way as the first example, and the space between the upper and lower blade edge lines 24, 25 of the end sections of the side that is parallel to the length of the cutter body 8 is narrower than the space at the other end. Further, the rakes or angles of the upper and lower blades 22, 23 are also only on the cutting side in the same way as the first example.

FIGS. 11 and 12 show conditions for use of the second example corner cutter A2. The end section of the side that is parallel to the length of the cutter body 8 of the upper and lower blade edge lines 24, 25 is positioned alongside one edge of corner section 2 of plate glass 1 which forms a right angle. The other end is positioned near the other edge of comer section 2. First, a crack is produced in a position where the edge of the plate glass 1 and the upper and lower blade edge lines 24, 25 cross. This crack runs toward the other end section of the upper and lower blade edge lines 24, 25, and cutting of plate glass 1 along planned cut line C2 is possible when upper and lower blade edge sections 20, 21 are closed by squeezing the right and left handle sections 4, 3 as with the first example of FIG. 1.

Further, the end section of the side that does not cross with the plate glass 1 edge of upper and lower blade end lines 24, 25 does not contact the other edge of plate glass 1, and a force which separates the cut-off section outside planned cut line C2 is produced due to the rake or angle established on upper and lower blades 22, 23. This force directs the crack in the direction of the other edge and the crack is prevented from running toward the inside of planned finishing line B2.

Figure 14:
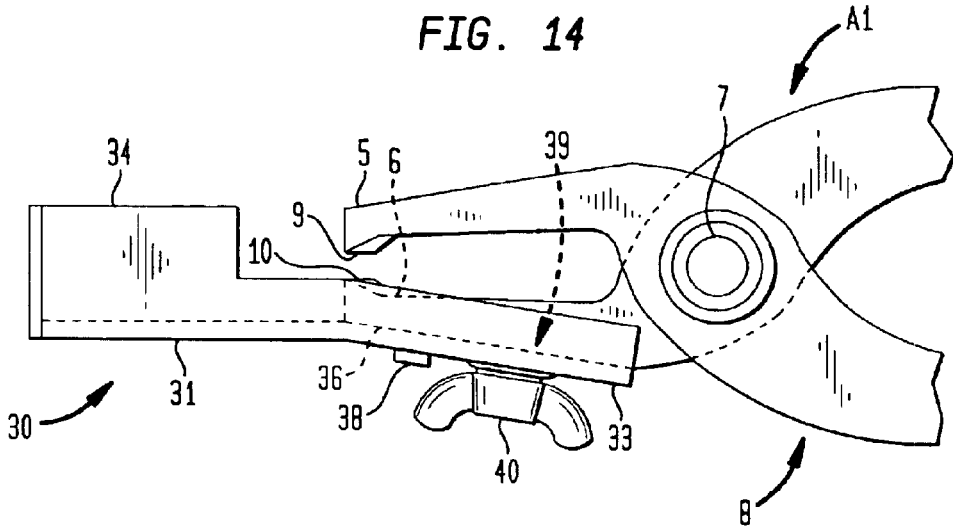
FIG. 14 is a view of a guide of the present invention.
Figure 15:
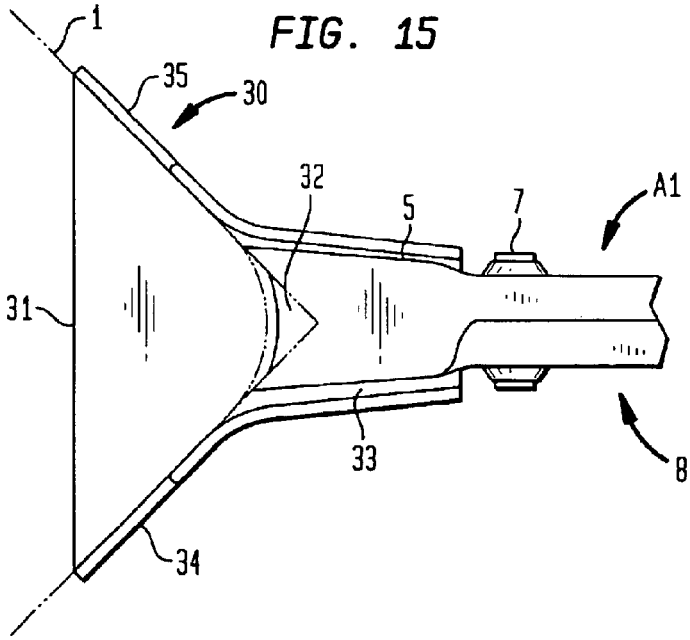
FIG. 15 is a plan view of the guide of the present invention.
Figure 16:
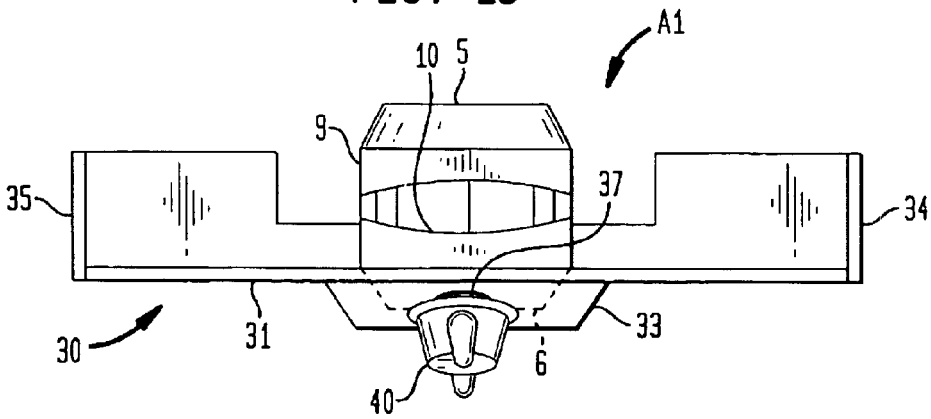
FIG. 16 is a front view of the guide of the present invention.

FIGS. 14–16 show a guide 30 mounted on corner cutter A1 of the first example for simplifying the positioning of corner cutter A1 on plate glass 1. Setting section 33 extends from a right angle end section 32 of the approximately right-angle isosceles triangle shaped bottom plate 31 in the direction of the cutter body 8 and the periphery of the two sides which secure the end position, The respective right and left guide plates 34, 35 are disposed on the right and left periphery of setting section 33 for guide 30, and position determining hole 36 and screw insertion hole 37 are formed in setting section 33.

Further, position determining projection 38 and hidden female screw hole 39 are formed on the outside surface of the lower blade edge section 6 of cutter body 8. Position determining projection 38 fits through position determining hole 36 of setting section 33 with guide 30 being fastened on corner cutter A1 by means of wing nut 40 which fastens onto a screw through female screw hole 39.

Thus, the right angle corner section 2 of plate glass 1 is inserted between the right and left guide plates 34, 35. When the periphery of that plate glass 1 abuts the inside surface of the right and left guide plates 34, 35, the position of the upper and lower blade edge sections 5, 6 of corner cutter A1 is correct. Efficient comer treatment operation can then be performed without requiring markingoff, since that can be easily determined.

Further, the corner cutter of this invention is not limited to the above-mentioned cutting of plate glass, but can be widely utilized for materials that are in a sheet form and are brittle such as mirrors, bathroom tiles and roof tiles.

Effects such as the following can be obtained by the present invention.

The invention utilizes the opening and closing motions of upper and lower blades to result in cutting of plate glass due to the upper and lower blade edge lines mutually opposing each other in a cutter body that is formed in a scissor-like shape. Further, a corner section of plate glass can be cut on a planned cut line by one opening and closing operation of the upper and lower blade edge sections and the efficiency of corner section treatment operations can be improved since the upper and lower blade edge lines substantially coincide at a planned cut line of a corner section of plate glass.

The invention can produce a crack with little clamping pressure by restricting the origin of a crack that is produced by the clamping pressure of the upper and lower blades to the plate glass periphery when a corner section is cut. This results from positioning at least one end section of the upper and lower blade edge at the periphery of the plate glass when the upper and lower blades are closed.

The invention has the distribution of the clamping pressure to the plate glass being greatest at the end sections with the space of the upper and lower blade edge line being narrow and the direction in which the crack runs can be controlled while the crack can be prevented from going beyond the planned cut line.

The invention provides the simple shaping of a corner section with a center section curving to the outside and the center sections of the upper and lower blade edge lines curve to the cutter body side.

The invention also provides the simple formation of a corner section curving to the inside and the center sections of the upper and lower blade edge lines curve to the reverse side of the cutter body.

It will be understood that the embodiments described herein are merely exemplary and that a person skilled in the art may make many variations and modifications without departing from the sphere and scope of the invention. All such variations and modifications are intended to be included in the scope of the invention as defined in the appended claims.

What is claimed is:

1. A corner cutter comprising:

a cutter body including upper and lower handles having a pivot securing said handles together, said lower handle having an upper blade end extending beyond said pivot and having an arcuate first blade edge secured thereto, said upper handle having a lower blade end extending beyond said pivot and opposing said upper blade end, said lower blade end having an arcuate second blade edge secured thereto, said handles and blade ends being pivotable about said pivot to provide opposing movement of said first and second blade edges between an open and closed position, said first and second blade edges being disposed in mutually opposing positions and the space between said first and second blade edges varies along the length of the edges when said first and second cutting edges are in the closed position for cutting sheets of brittle material positioned between said blade edges, and the variation in the space between said first and second blade edges adapted to engage a sheet of brittle material along a sequence of contact points providing greatest pressure at the contact edges of said first and second arcuate blade edges and a sheet of brittle material disposed between said first and second arcuate blade edges as said first and second arcuate blade edges are brought to the closed position.

2. The device of claim 1 wherein said first and said second blade edges each have outer portions and an inner portion and the distance between the opposing outer portions of said first and second blade edges is less than the distance between said inner portions of said first and second blade edges.

3. The device of claim 1 wherein the outer portions of said opposing blade ends are curved for cutting curves into said sheets of brittle material between said edges.

4. The device of claim 1 wherein said first and said second blade edges each contain a portion parallel to the axis of said pivot.

5. The device of claim 1 wherein said arcuate curved first and second blade edges are concave with respect to the axis of said pivot to cut an outer curve.

6. The device of claim 1 wherein said arcuate curved first and second blade edges are convex with respect to the axis of said pivot to cut an inner curve.

7. The device of claim 1 wherein said first and said second blade edges each have two opposing outer portions and an opposing inner portion and the space between one of the two opposing outer portions of said first and said second blade edges is less than the space between the other of said opposing outer portions of said first and said second blade edges.

8. The device of claim 1 including a return spring connected between said upper and lower handles.

9. The device of claim 8 including stop means connected between opposite ends of said upper and lower handles for maintaining said handles in a normally open position.

10. The device of claim 1 wherein the opposing blade edges are disposed to be perpendicular to the surfaces of sheets of brittle material there between.

11. The device of claim 10 wherein one of the opposing blade edges has an angled inner surface providing a sharp edge for cutting said brittle material.

12. The device of claim 10 including a guide secured to said lower blade end for positioning said lower blade end on a sheet of brittle material for simplifying the cutting of said sheet.

* * * * *